US010561284B2

(12) United States Patent
Okamoto et al.

(10) Patent No.: US 10,561,284 B2
(45) Date of Patent: Feb. 18, 2020

(54) HAND DRYER

(71) Applicant: MITSUBISHI ELECTRIC CORPORATION, Chiyoda-ku, Tokyo (JP)

(72) Inventors: Kazuki Okamoto, Tokyo (JP); Takaki Kobayashi, Tokyo (JP); Yasuyuki Itoigawa, Tokyo (JP); Yukimichi Imai, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 38 days.

(21) Appl. No.: 15/746,741

(22) PCT Filed: Jul. 24, 2015

(86) PCT No.: PCT/JP2015/071165
§ 371 (c)(1),
(2) Date: Jan. 22, 2018

(87) PCT Pub. No.: WO2017/017736
PCT Pub. Date: Feb. 2, 2017

(65) Prior Publication Data

US 2018/0213983 A1 Aug. 2, 2018

(51) Int. Cl.
*A47K 10/48* (2006.01)

(52) U.S. Cl.
CPC ..... *A47K 10/48* (2013.01)

(58) Field of Classification Search
CPC ..... F26B 35/08; F26B 19/00; F26B 21/06; F26B 21/00; A47K 10/48; G01F 23/26
(Continued)

(56) References Cited

U.S. PATENT DOCUMENTS 5,459,944 A * 10/1995 Tatsutani ..... A47K 10/48 34/202
5,568,691 A * 10/1996 Rubin ..... A45D 20/16 34/98

(Continued)

FOREIGN PATENT DOCUMENTS

EP 3326503 A4 * 3/2019 ..... A47K 10/48
JP 10-257994 A 9/1998

(Continued)

OTHER PUBLICATIONS

Office Action (Notification of Reasons for Refusal) dated Jun. 12, 2018, by the Japanese Patent Office in corresponding Japanese Patent Application No. 2017-530478 and English translation of the Office Action. (4 pages).

(Continued)

*Primary Examiner* — Stephen M Gravini
(74) *Attorney, Agent, or Firm* — Buchanan Ingersoll & Rooney PC

(57) ABSTRACT

A hand dryer includes an air-stream generating device including a device air inlet, an inner housing that accommodates therein the air-stream generating device and has an inner air inlet formed in an intake surface thereof, and an outer housing that accommodates therein the inner housing and the air-stream generating device and has an outer air inlet formed therein. An intake air passage that connects the outer air inlet and the device air inlet to each other is formed inside the outer housing to include the intake surface and an opposing surface as a portion of a wall surface thereof, and a projection is provided on the opposing surface to project from a region that is opposed to the inner air inlet towards the intake surface. The projection has a first surface facing an upstream side in the intake air passage.

7 Claims, 8 Drawing Sheets

(58) Field of Classification Search
USPC ..... 34/202
See application file for complete search history.

(56) References Cited

U.S. PATENT DOCUMENTS

| | | | | | |
|---|---|---|---|---|---|
| 6,038,786 | A * | 3/2000 | Aisenberg | A47K 10/48 | 34/202 |
| 7,437,833 | B2 * | 10/2008 | Sato | A47K 10/48 | 34/90 |
| 7,596,883 | B2 * | 10/2009 | Kameishi | A47K 10/48 | 250/432 R |
| 7,614,160 | B2 * | 11/2009 | Kameishi | A47K 10/48 | 34/90 |
| 7,657,162 | B2 * | 2/2010 | Itoigawa | A47K 10/48 | 392/380 |
| 7,971,368 | B2 * | 7/2011 | Fukaya | A47K 10/48 | 222/1 |
| 8,341,853 | B2 * | 1/2013 | French | A47K 10/48 | 15/300.1 |
| 8,347,521 | B2 * | 1/2013 | Churchill | A47K 10/48 | 134/26 |
| 8,347,522 | B2 * | 1/2013 | Dyson | A47K 10/48 | 34/90 |
| 8,490,291 | B2 * | 7/2013 | Churchill | A47K 10/48 | 222/1 |
| 8,739,430 | B2 * | 6/2014 | Fukaya | A47K 10/48 | 34/202 |
| 8,850,713 | B2 * | 10/2014 | Nakamura | A47K 10/48 | 132/73 |
| 9,060,657 | B2 * | 6/2015 | Ryan | A47K 10/48 | |
| 9,125,533 | B2 * | 9/2015 | Babikian | A47K 10/485 | |
| 9,538,886 | B2 * | 1/2017 | Ros Marin | A47K 10/48 | |
| 9,826,865 | B2 * | 11/2017 | Maruyama | G01F 23/268 | |
| 10,264,931 | B2 * | 4/2019 | Childress | A47K 10/48 | |
| 2007/0079524 | A1 * | 4/2007 | Sato | A47K 10/48 | 34/202 |
| 2011/0023319 | A1 * | 2/2011 | Fukaya | A47K 10/48 | 34/202 |
| 2013/0031799 | A1 * | 2/2013 | Gagnon | A47K 10/48 | 34/526 |
| 2017/0007081 | A1 * | 1/2017 | Homma | A47K 10/48 | |
| 2018/0213983 | A1 * | 8/2018 | Okamoto | A47K 10/48 | |
| 2019/0099050 | A1 * | 4/2019 | Kirschman | A47K 10/48 | |

FOREIGN PATENT DOCUMENTS

| | | | | | |
|---|---|---|---|---|---|
| JP | 2004-215879 | A | 8/2004 | | |
| JP | 3791009 | B2 | 6/2006 | | |
| JP | 2013-022226 | A | 2/2013 | | |
| JP | WO2017017736 | A1 * | 10/2017 | A47K 10/48 | |
| JP | 6469227 | B2 * | 2/2019 | A47K 10/48 | |
| WO | WO-2017017736 | A1 * | 2/2017 | A47K 10/48 | |

OTHER PUBLICATIONS

Office Action (Patent Examination Report No. 1) dated Jul. 3, 2018, by the Australian Patent Office in corresponding Australian Patent Application No. 2015403646. (3 pages).

Extended European Search Report dated Feb. 13, 2019, issued by the European Patent Office in corresponding European Application No. 15899570.4. (9 pages).

Notice of Reasons for Refusal for Taiwanese Patent Application No. 105102169, dated Sep. 29, 2017.

International Search Report (PCT/ISA/210) dated Sep. 29, 2015, by the Japanese Patent Office as the International Searching Authority for International Application No. PCT/JP2015/071165.

Written Opinion (PCT/ISA/237) dated Sep. 29, 2015, by the Japanese Patent Office as the International Searching Authority for International Application No. PCT/JP2015/071165.

Office Action dated Nov. 6, 2019, by the Chinese Patent Office in corresponding Chinese Patent Application No. 201580081870.9 and English translation of the Office Action. (18 pages).

* cited by examiner

HAND DRYER

FIELD

The present invention relates to a hand dryer that blows air to wet hands to dry the hands in a sanitary manner.

BACKGROUND

There has been used a hand dryer that dries wet hands by blowing air from a nozzle to the wet hands and blowing off water drops. Such a hand dryer includes a high-pressure air-stream generating device for blowing out air from a nozzle to blow water drops off. Operation sound generated during the operation of the high-pressure air-stream generating device becomes noise when it leaks to outside the hand dryer through an air passage that is formed inside the hand dryer. A hand dryer disclosed in Patent Literature 1 attempts to reduce noise that leaks to outside thereof by attaching a sound absorbing material to an air passage.

CITATION LIST

Patent Literature

Patent Literature 1: Japanese Patent No. 3791009

SUMMARY

Technical Problem

However, in the hand dryer disclosed in Patent Literature 1, attaching of the sound absorbing material increases its manufacturing cost. Further, when the attached sound absorbing material is peeled off, there is a risk that the high-pressure air-stream generating device sucks in the peeled off sound absorbing material and the device fails, so that there is a case where the reliability of the hand dryer is lowered.

The present invention has been achieved in view of the above problems, and an object of the present invention is to provide a hand dryer that can reduce generated noise while suppressing increase of its manufacturing cost and deterioration of the reliability of product.

Solution to Problem

In order to solve the above problems and achieve the object, a hand dryer according to the present invention includes: an air-stream generating device that blows out air, which is taken from a device air inlet, from a device air outlet; an inner housing that accommodates therein the air-stream generating device and has an inner air inlet formed in an intake surface thereof that is opposed to the device air inlet; and an outer housing that accommodates therein the inner housing and the air-stream generating device and has an outer air inlet and an outer air outlet formed therein. Further, in the hand dryer, an intake air passage that connects the outer air inlet and the device air inlet to each other is formed inside the outer housing while including the intake surface and an opposing surface that is opposed to the intake surface as a portion of a wall surface thereof. A projection is provided on the opposing surface to project from a region that is opposed to the inner air inlet towards the intake surface, the projection includes a first surface facing an upstream side in the intake air passage.

Advantageous Effects of Invention

According to the hand dryer of the present invention, an effect is obtained where generated noise can be reduced while suppressing increase of its manufacturing cost and deterioration of the reliability of product.

DESCRIPTION OF EMBODIMENTS

A hand dryer according to an embodiment of the present invention will be described in detail below with reference to the accompanying drawings. The present invention is not limited to the embodiment.

Embodiment

Figure 1:
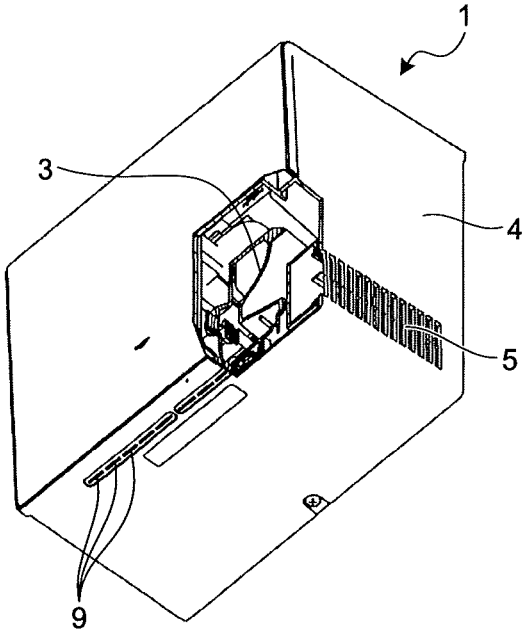
FIG. 1 is a perspective view of a hand dryer according to a embodiment of the present invention.
Figure 2:
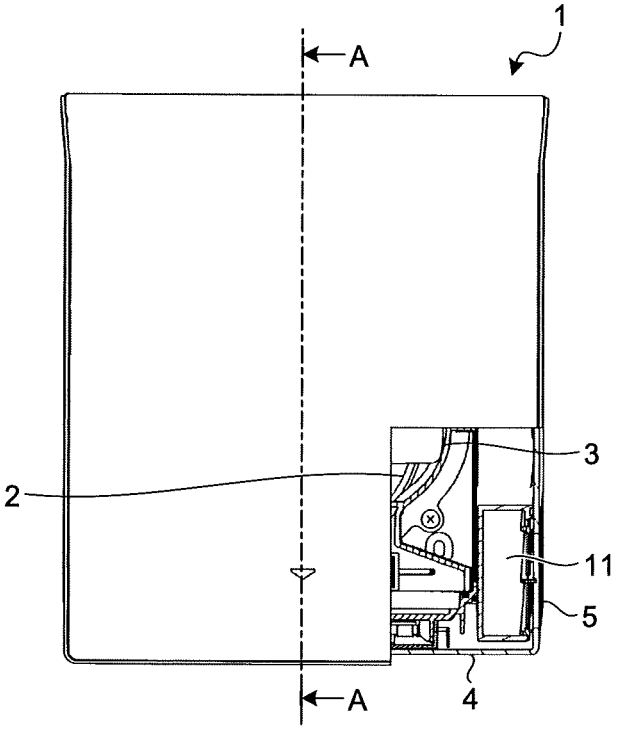
FIG. 2 is a front view of the hand dryer according to the embodiment.
Figure 3:
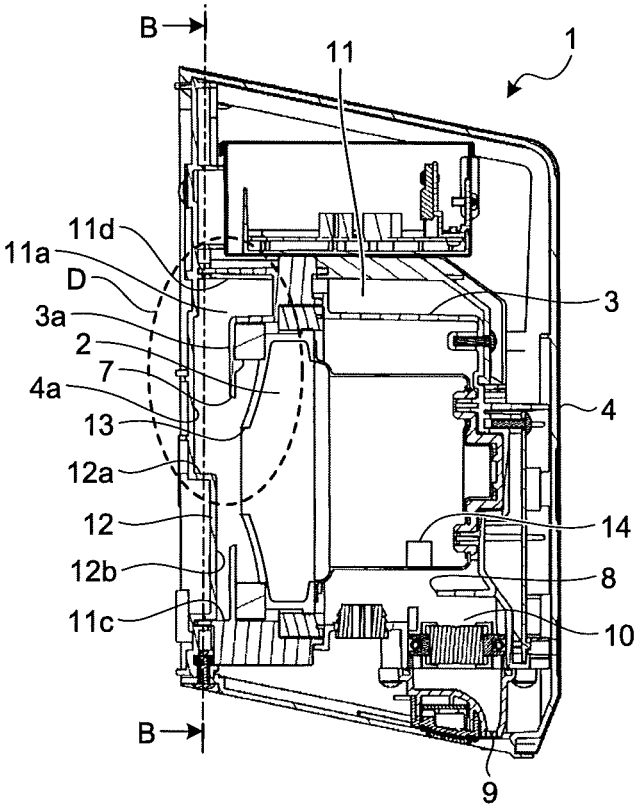
FIG. 3 is a cross-sectional view of the hand dryer according to the embodiment taken along a line A-A in FIG. 2.
Figure 4:
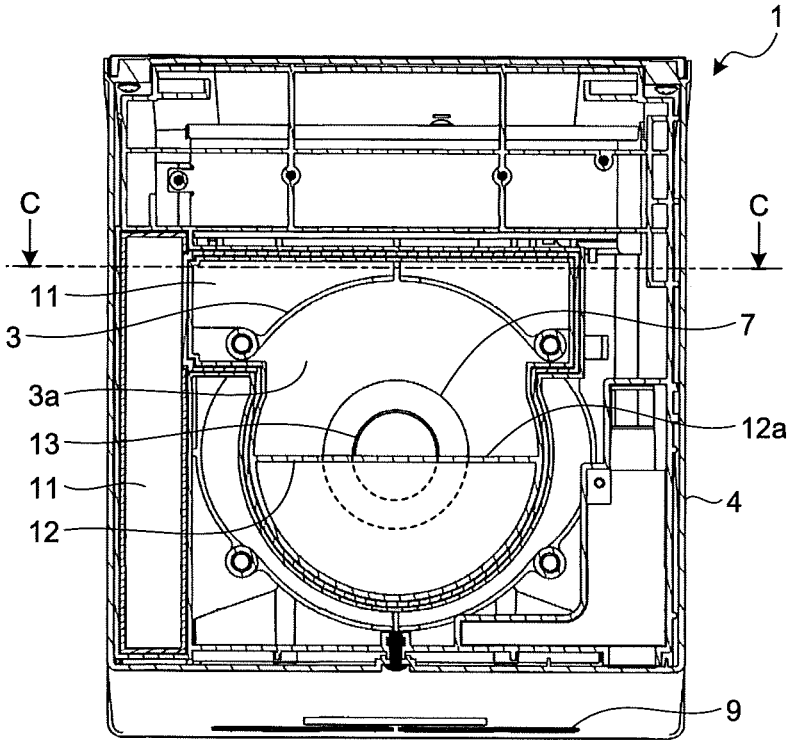
FIG. 4 is a cross-sectional view of the hand dryer according to the embodiment taken along a line B-B in FIG. 3.
Figure 5:
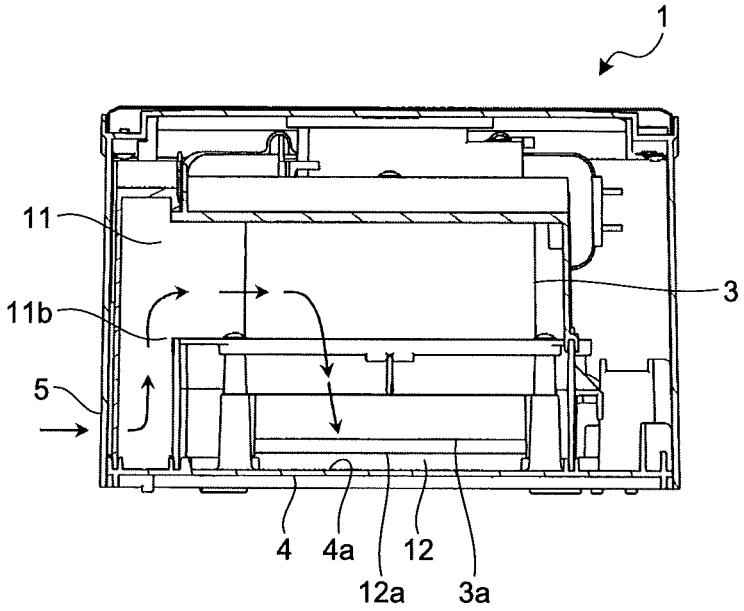
FIG. 5 is a cross-sectional view of the hand dryer according to the embodiment taken along a line C-C in FIG. 4.
Figure 6:
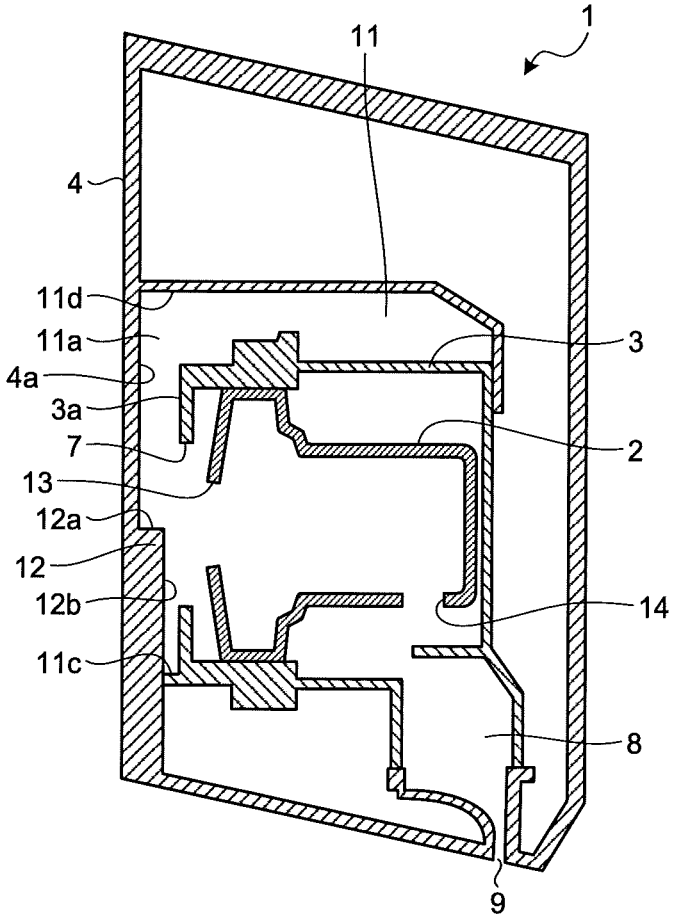
FIG. 6 is a cross-sectional view illustrating an internal structure of the hand dryer according to the embodiment in a simplified manner taken along the line A-A in FIG. 2.
Figure 7:
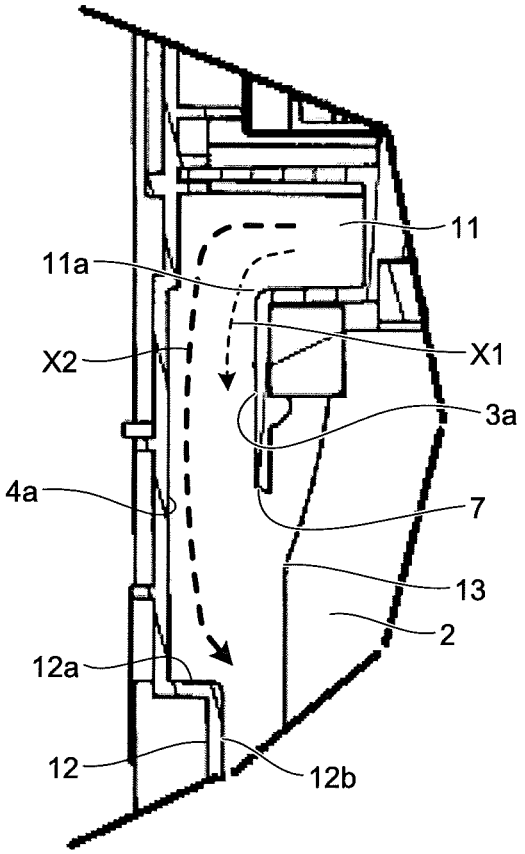
FIG. 7 is a partial enlarged cross-sectional view of the hand dryer according to the embodiment, in which a portion D illustrated in FIG. 3 is enlarged.

FIG. 1 is a perspective view of a hand dryer according to an embodiment of the present invention. FIG. 2 is a front view of the hand dryer according to the embodiment. FIG. 3 is a cross-sectional view of the hand dryer according to the embodiment taken along a line A-A in FIG. 2. FIG. 4 is a cross-sectional view of the hand dryer according to the embodiment taken along a line B-B in FIG. 3. FIG. 5 is a cross-sectional view of the hand dryer according to the embodiment taken along a line C-C in FIG. 4. FIG. 6 is a cross-sectional view illustrating an internal structure of the hand dryer according to the embodiment in a simplified manner taken along the line A-A in FIG. 2. FIG. 7 is a partial enlarged cross-sectional view of the hand dryer according to the embodiment, in which a portion D illustrated in FIG. 3 is enlarged. In FIG. 3, the left side of the drawing is a front-surface side. In FIG. 5, the lower side of the drawing is the front-surface side.

A hand dryer 1 includes a high-pressure air-stream generating device 2 as an air-stream generating device, an inner housing 3 that accommodates therein the high-pressure air-stream generating device 2, and an outer housing 4 that accommodates therein the inner housing 3.

A device air inlet 13 and a device air outlet 14 are formed in the high-pressure air-stream generating device 2. During the operation of the high-pressure air-stream generating device 2, as air is taken in from the device air inlet 13 and the taken air is blown out from the device air outlet 14, a high-pressure air stream is generated. As illustrated in FIG. 4, the device air inlet 13 is circular in a front view.

The inner housing 3 accommodates the high-pressure air-stream generating device 2 therein. An inner air inlet 7 and an inner air outlet 8 are formed in the inner housing 3. The inner air inlet 7 is formed in an intake surface 3*a* that is opposed to the device air inlet 13 of the high-pressure air-stream generating device 2. During the operation of the high-pressure air-stream generating device 2, air is taken into the inner housing 3 through the inner air inlet 7, and the taken air is blown out through the inner air outlet 8. As illustrated in FIG. 4, the inner air inlet 7 is circular in a front view. The inner air inlet 7 is formed to have a larger size than the device air inlet 13 and to be concentric with the device air inlet 13 in a front view.

The outer housing 4 forms an outline of the hand dryer 1. An outer air inlet 5 and nozzles 9 as outer air outlets are formed on the outer housing 4. An intake air passage 11 and a discharge air passage 10 are formed inside the outer housing 4. The intake air passage 11 is an air passage that connects the outer air inlet 5 and the inner air inlet 7 to each other. The discharge air passage 10 is an air passage that connects the inner air outlet 8 and the nozzles 9 to each other. With the above configuration of the air passages, during the operation of the high-pressure air-stream generating device 2, air taken into the intake air passage 11 from the outer air inlet 5 passes through the discharge air path 10 and is blown out from the nozzles 9 as a high-pressure air stream. When wet hands are placed to be opposed to the nozzles 9, water drops on the hands are blown off by the air blown out from the nozzles 9.

A wall surface constituting the intake air passage 11 includes the intake surface 3*a* of the inner housing 3 and an opposing surface 4*a* that is opposed to the intake surface 3*a*. Although the opposing surface 4*a* is provided in the outer housing 4 in the present embodiment, the opposing surface may be provided in another constituent element from the outer housing 4.

A projection 12 is provided on the opposing surface 4*a*, projecting from a region that is opposed to the inner air inlet 7 towards the intake surface 3*a*. The projection 12 includes a first surface 12*a* facing an upstream side in the intake air passage 11. The first surface 12*a* is located in the region that is opposed to the inner air inlet 7. The projection 12 also includes a second surface 12*b* that extends from a tip of the first surface 12*a*, that is, an end on the side of the intake surface 3*a* of the first surface 12*a*, towards a downstream side in the intake air passage 11 and that is opposed to the intake surface 3*a*.

In the present embodiment, the distance between the second surface 12*b* and the intake surface 3*a* in a front-back direction is equal to or less than ½ of the distance between the opposing surface 4*a* and the intake surface 3*a* in the front-back direction. In other words, the distance between the tip of the first surface 12*a* and the intake surface 3*a* is equal to or less than ½ of the distance between the opposing surface 4*a* and the intake surface 3*a*. The distance between the second surface 12*b* and the intake surface 3*a* in the front-back direction is not limited to this condition.

As illustrated in FIGS. 6 and 7, the intake air passage 11 is formed by being bent in a direction in which the intake air passage 11 is away from the opposing surface 4*a*, in midway to the upstream side in the intake air passage 11 from the inner air inlet 7. The portion of the intake air passage 11 bent in the direction in which the intake air passage 11 is away from the opposing surface 4*a* is called a bent portion 11*a*. The intake air passage 11 is also bent on an upstream side of the bent portion 11*a*, and the bent portion 11*b* illustrated in FIG. 5 corresponds to this portion. That is, a plurality of bent portions 11*a* and 11*b* are formed in the intake air passage 11. By forming the bent portions 11*a* and 11*b* in the intake air passage 11, operation sound of the high-pressure air-stream generating device 2 hardly leaks to outside through the intake air passage 11, and therefore reduction of noise can be achieved.

Further, with the configuration of the intake air passage 11 of the hand dryer 1 according to the embodiment, as indicated with an arrow in FIG. 7, air that flows in parallel to the inner air inlet 7 is guided by the first surface 12*a* to a direction towards the inner air inlet 7, that is, a direction towards the device air inlet 13 of the high-pressure air-stream generating device 2. In FIG. 7, air passing inside the bent portion 11*a* is indicated with an arrow X1, and air passing outside thereof is indicated with an arrow X2.

As for the air having passed by the bent portion 11*a*, the air passing outside the bent portion 11*a* indicated with the arrow X2 flows at a higher speed than the air passing inside the bent portion 11*a* indicated with the arrow X1. Therefore, an air stream becomes faster on the side of the opposing surface 4*a* that is away from the inner air inlet 7, so that air is hardly taken into the inner air inlet 7. That is, the air that having passed by the bent portion 11*a* is biased towards the side of the opposing surface 4*a*.

However, the air stream is guided to the direction towards the inner air inlet 7 by the first surface 12*a* provided in the projection 12. Therefore, the air passing outside the bent portion 11*a* indicated with the arrow X2 is also taken in from the inner air inlet 7 smoothly. That is, the first surface 12*a* functions as a regulating portion that guides the air that flows while being biased towards the opposing surface 4*a*, towards the device air inlet 13.

Figure 8:
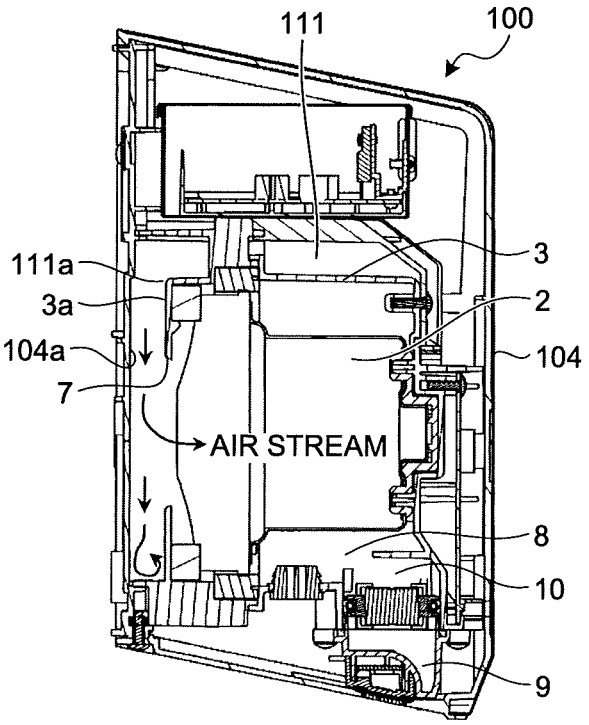
FIG. 8 is a cross-sectional view of a hand dryer illustrated as a comparative example and corresponding to FIG. 3.
Figure 9:
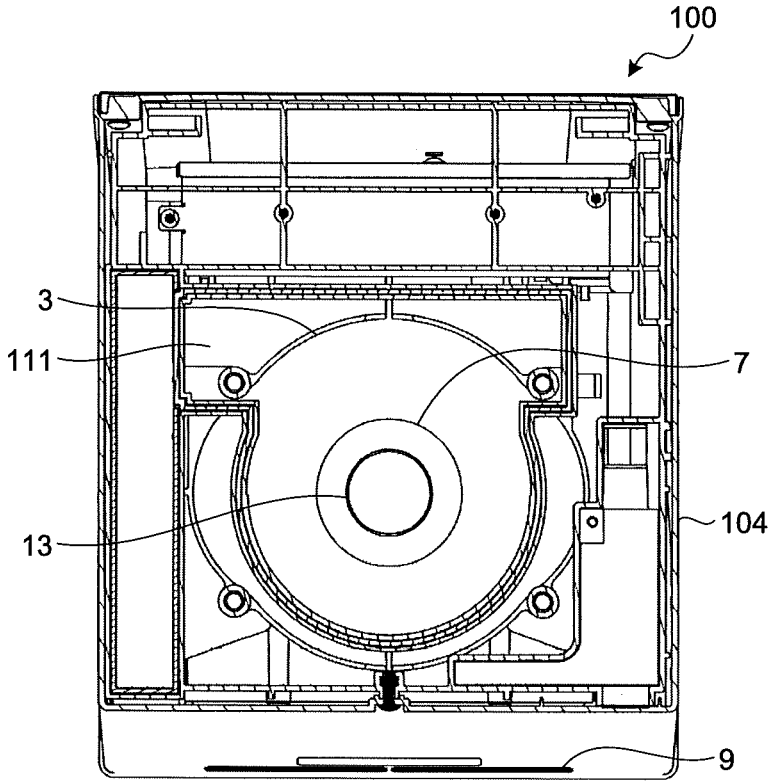
FIG. 9 is a cross-sectional view of the hand dryer illustrated as the comparative example and corresponding to FIG. 4.

A hand dryer as a comparative example is described here. FIG. 8 is a cross-sectional view of a hand dryer illustrated as a comparative example and corresponding to FIG. 3. FIG. 9 is a cross-sectional view of the hand dryer illustrated as the comparative example and corresponding to FIG. 4. A hand dryer 100 described as the comparative example is different from the hand dryer 1 according to the embodiment in the configuration of an outer housing 104. More specifically, any projection is not formed in an intake air passage 111. Therefore, the interval between an opposing surface 104*a* and the intake surface 3*a* is constant on a downstream side relative to a bent portion 111*a*.

In a portion where the interval between the opposing surface 104*a* and the intake surface 3*a* is constant, sound is reflected within the intake air passage 111, so that noise caused by resonance is easily generated. Meanwhile, in the hand dryer 1 according to the embodiment, the projection 12 is provided in the intake air passage 11 and therefore the side of the opposing surface 4*a* and the side of the intake surface 3*a* are asymmetrical with each other. Due to this configuration, the length of an air passage having a constant interval causing resonance can be suppressed, so that noise can be suppressed.

Furthermore, in the hand dryer 100 described in the comparative example, the first surface 12*a* is not provided. Therefore, the air stream is hardly guided towards the inner air inlet 7, and it is difficult to cause air to be taken into the inner air inlet 7 smoothly. Further, the air having passed by a front surface of the inner air inlet 7 without being taken into the inner air inlet 7 collides with a downstream end of the intake air passage 11 and circulates in a downstream end portion, thereby causing disturbance of the air stream. The disturbance of the air stream may cause occurrence of noise.

Meanwhile, as illustrated in FIG. 7, the air stream is made smooth in the hand dryer 1 according to the embodiment. Therefore, disturbance of the air stream hardly occurs, so that noise can be suppressed.

Figure 10:
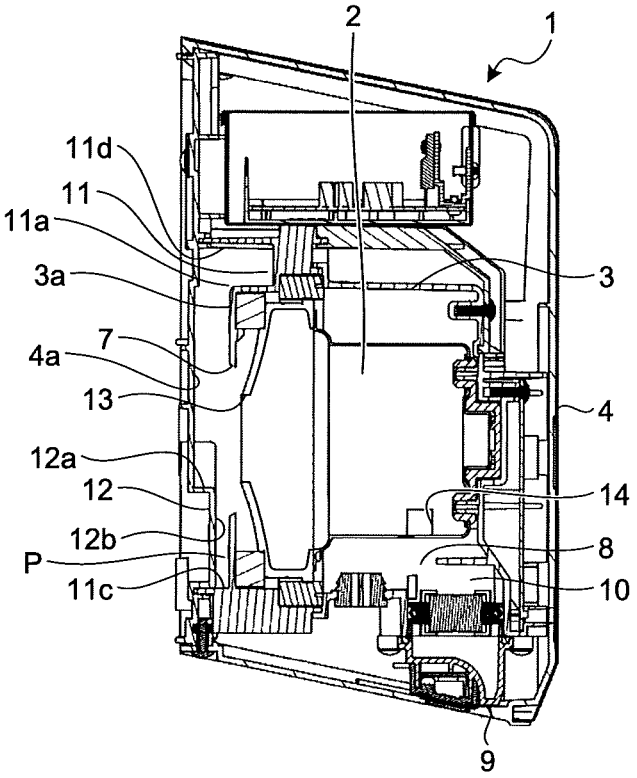
FIG. 10 is a cross-sectional view of a hand dryer according to a first modification of the embodiment and corresponding to FIG. 3.
Figure 11:
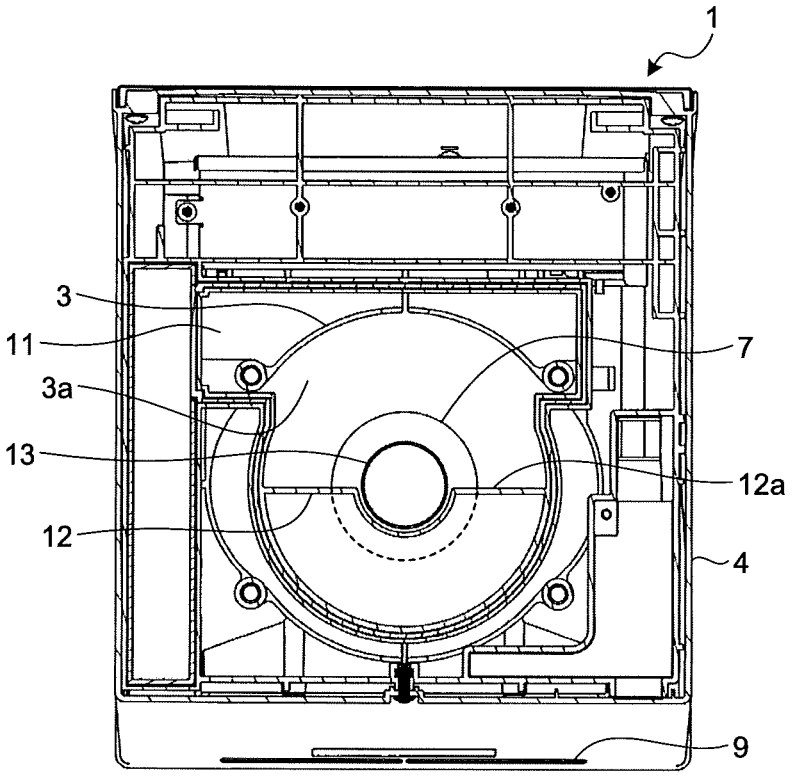
FIG. 11 is a cross-sectional view of the hand dryer according to the first modification of the embodiment and corresponding to FIG. 4.

Next, an example of the form of the projection 12 is described. FIG. 10 is a cross-sectional view of the hand dryer 1 according to a first modification of the embodiment and corresponding to FIG. 3. FIG. 11 is a cross-sectional view of the hand dryer 1 according to the first modification of the embodiment and corresponding to FIG. 4.

As illustrated in FIG. 11, in the hand dryer 1 according to the first modification, a portion of the first surface 12*a* has a form of an arc surface, while avoiding a region thereof that is opposed to the device air inlet 13. In other words, the projection 12 is formed to avoid a region where the device air inlet 13 is projected onto the opposing surface 4*a*. Due to this configuration, it is possible to allow air to be taken in from the device air inlet 13 more smoothly in the region that is opposed to the device air inlet 13 without narrowing the width of the intake air passage 11.

Further, a space P surrounded by the intake surface 3*a* of the inner housing 3, a bottom surface 11*c* as a third surface of the intake air passage 11, and the second surface 12*b* functions as an expansion-type silencing space. Therefore, noise generated from the high-pressure air-stream generating device 2 can be reduced. Because the expansion-type silencing space is provided in the vicinity of the inner air inlet 7, noise generated from the high-pressure air-stream generating device 2 can be silenced before being diffused in the intake air passage 11, and therefore a greater silencing effect can be expected. Further, a fourth surface 11*d* as a top surface is also formed in the intake air passage 11.

Figure 12:
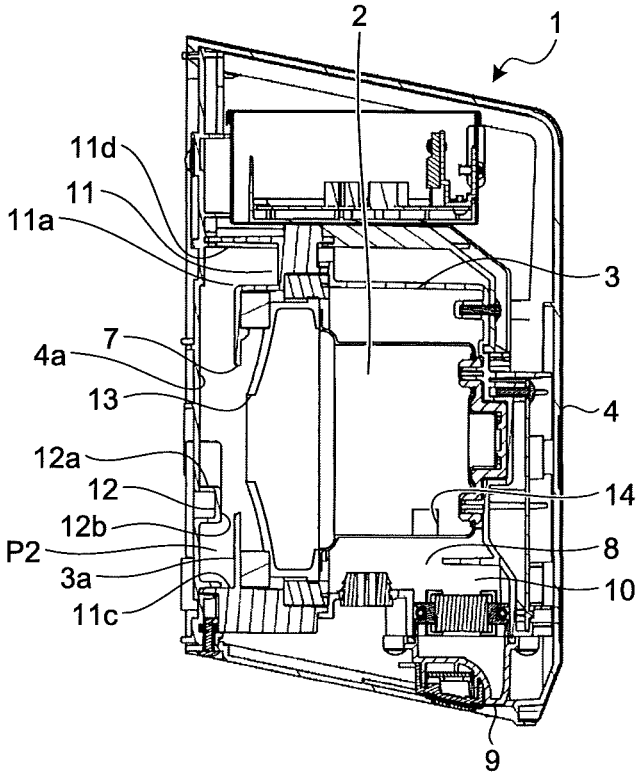
FIG. 12 is a cross-sectional view of a hand dryer according to a second modification of the embodiment and corresponding to FIG. 3.
Figure 13:
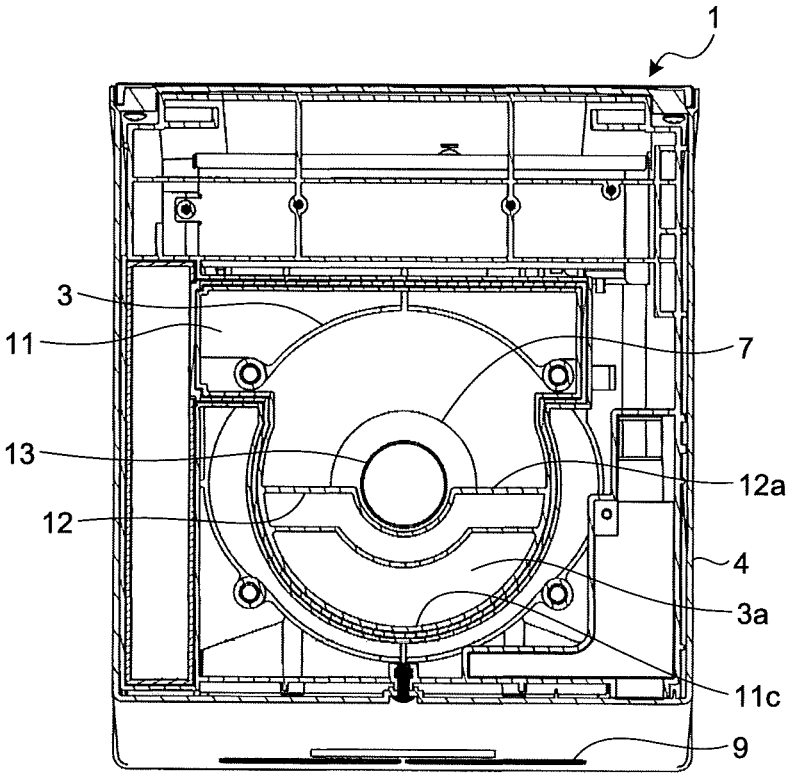
FIG. 13 is a cross-sectional view of the hand dryer according to the second modification of the embodiment and corresponding to FIG. 4.

FIG. 12 is a cross-sectional view of a hand dryer according to a second modification of the embodiment and corresponding to FIG. 3. FIG. 13 is a cross-sectional view of the hand dryer according to the second modification of the embodiment and corresponding to FIG. 4.

In the hand dryer 1 according to the second modification, the second surface 12*b* does not reach the bottom surface 11*c* of the intake air passage 11. Therefore, a space P2 serving as an expansion-type silencing space has a passage width that varies depending on a position, and thus a silencing effect can be expected for a wide frequency bandwidth. While FIGS. 12 and 13 illustrate the projection 12 that is constant in a projecting height, when the projection 12 is formed to have a plurality of projecting heights or a projection is provided on the downstream side relative to the projection 12 to have a different height from the projection 12, the expansion-type silencing space can have a more passage width. Therefore, a silencing effect can be expected for a wider frequency bandwidth.

Figure 14:
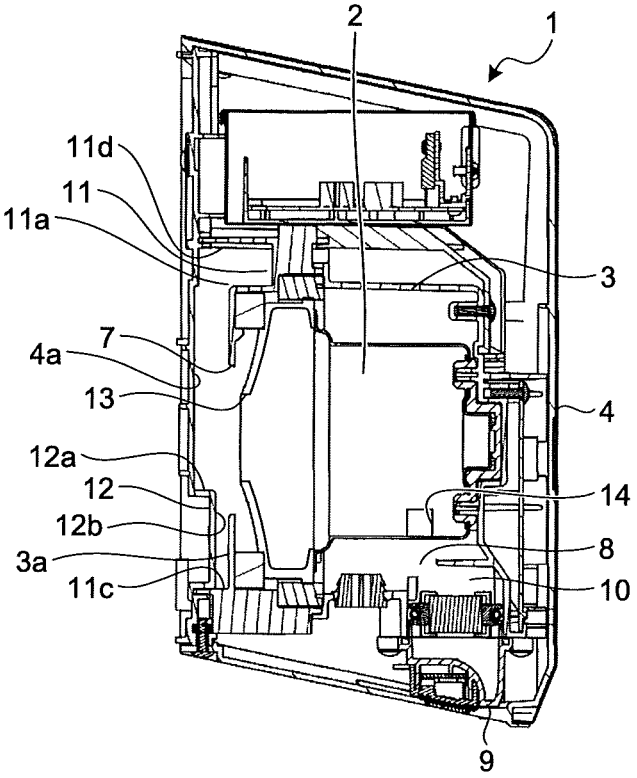
FIG. 14 is a cross-sectional view of a hand dryer according to a third modification of the embodiment and corresponding to FIG. 3.
Figure 15:
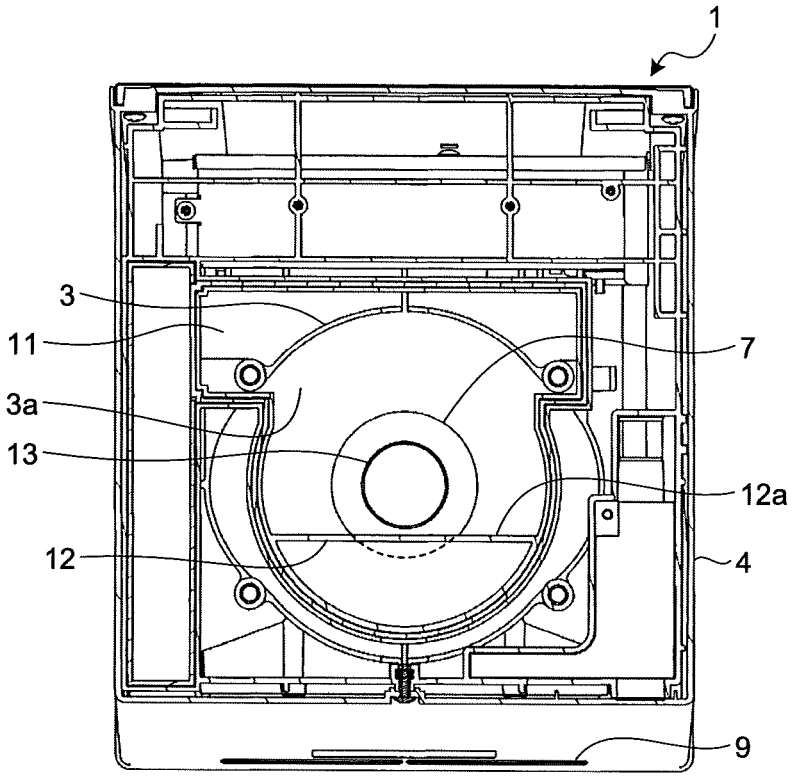
FIG. 15 is a cross-sectional view of the hand dryer according to the third modification of the embodiment and corresponding to FIG. 4.

FIG. 14 is a cross-sectional view of a hand dryer according to a third modification of the embodiment and corresponding to FIG. 3. FIG. 15 is a cross-sectional view of the hand dryer according to the third modification of the embodiment and corresponding to FIG. 4. In the hand dryer 1 according to the third modification, the entire portion of the first surface 12*a*, that is, the entire portion of the projection 12, is provided on a downstream side relative to a region that is opposed to the device air inlet 13.

In the hand dryer 1 according to the third modification, it is possible to cause the projection 12 to function as a regulating portion that guides an air stream biased towards the side of the opposing surface 4*a* of the intake air passage 11 due to the bent portion 11*a* of the intake air passage 11, towards the device air inlet 13, while avoiding reduction of the passage effective area in association with providing of the projection 12.

The form of the first surface 12*a* as viewed from the side thereof (the form illustrated in each of FIGS. 3, 6, 10, 12, and 14) may be formed in the form of an arc instead of a flat plane, so as to improve the regulating effect for directing air towards inner air inlet 7.

Figure 16:
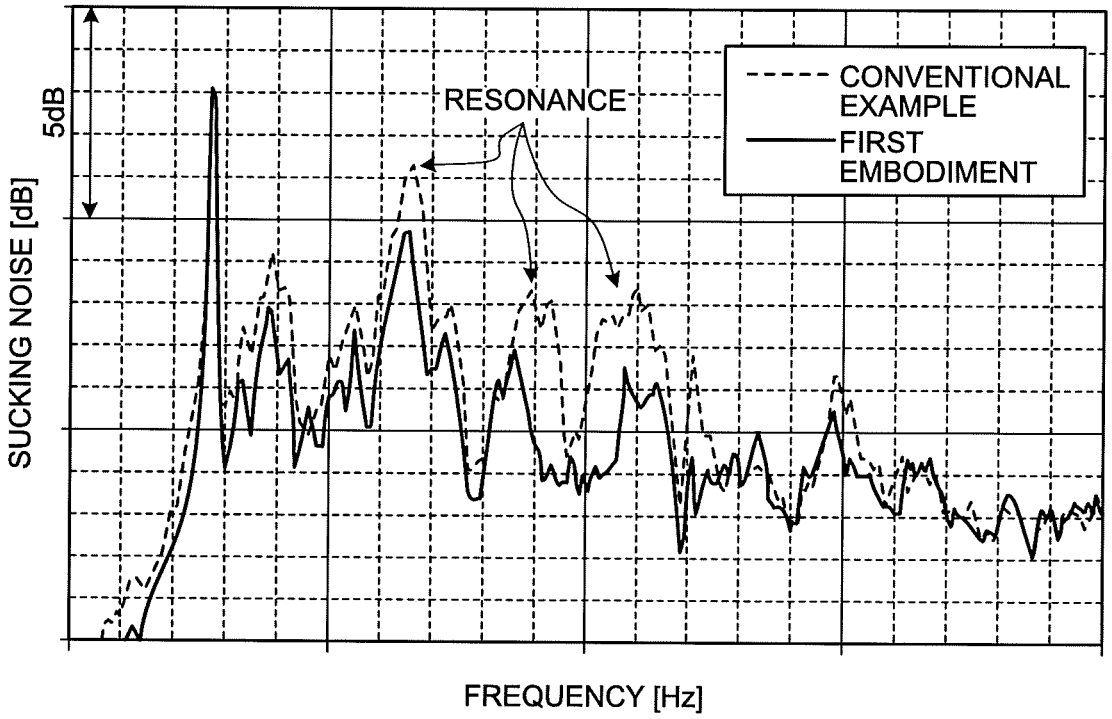
FIG. 16 is a diagram of comparison of FFT (Fast Fourier Transform) waveforms of noise generated in the hand dryer according to the first embodiment and noise generated in the hand dryer illustrated as the comparative example.

FIG. 16 is a diagram of comparison of FFT (Fast Fourier Transform) waveforms of noise generated in the hand dryer according to the embodiment and noise generated in the hand dryer illustrated as the comparative example. The TFT waveform of the noise generated in the hand dryer 1 according to the embodiment illustrated in FIG. 16 has been measured by using the hand dryer 1 according to the third modification.

As illustrated in FIG. 16, the hand dryer 1 according to the embodiment can reduce noise in a wider frequency bandwidth as compared with the hand dryer 100 described as the comparative example. Particularly, the hand dryer 1 according to the embodiment exhibits an effect of reducing resonance in the intake air passage 11.

As describe above, the hand dryer 1 according to the embodiment includes the projection 12 that is formed on the opposing surface 4*a* that is opposed to the intake surface 3*a* of the inner housing 3 accommodating therein the high-pressure air-stream generating device 2. Therefore, the opposing surface 4*a* and the intake surface 3*a* having no projection 12 are asymmetrical with each other, and the distance between these elements is not constant, and thus wall surfaces on which sound is reflected are reduced, so that generation of resonance is suppressed and noise reduction of product can be expected.

Further, the first surface 12*a* formed in the projection 12 functions as a regulating portion, so that disturbance of an air stream can be reduced. As a result, noise reduction of product can be expected, while reduction of a pressure loss in the intake air passage 11 is achieved.

In the embodiment, although an intake air passage of a single-sided hand dryer in which the nozzles 9 are arranged in one line has been described as an example, the present invention can be also applied to an intake air passage of a double-sided hand dryer in which the nozzles 9 are arranged to be opposed to one another.

The configurations described in the above embodiment are only examples of the contents of the present invention.

The configurations can be combined with other well-known techniques, and a part of each configuration can be omitted or modified without departing from the scope of the present invention.

REFERENCE SIGNS LIST

1 hand dryer, 2 high-pressure air-stream generating device (air-stream generating device), 3 inner housing, 3*a* intake surface, 4 outer housing, 4*a* opposing surface, 5 outer air inlet, 7 inner air inlet, 8 inner air outlet, 9 nozzle (outer air outlet), 10 discharge air passage, 11 intake air passage, 11*a*, 11*b* bent portion, 11*c* bottom surface (third surface), 11*d* top surface (fourth surface), 12 projection, 12*a* first surface, 12*b* second surface, 13 device air inlet, 14 device air outlet, 100 hand dryer, 104 outer housing, 104*a* opposing surface, 111 intake air passage, 111*a* bent portion.

The invention claimed is:

1. A hand dryer comprising:

an air-stream generating device that blows out air, taken from a device air inlet, from a device air outlet;

an inner housing that accommodates therein the air-stream generating device and has an inner air inlet formed in an intake surface thereof that is opposed to the device air inlet; and an outer housing that accommodates therein the inner housing and the air-stream generating device and has an outer air inlet and an outer air outlet formed therein, wherein an intake air passage that connects the outer air inlet and the device air inlet to each other is formed inside the outer housing while including the intake surface and an opposing surface that is opposed to the intake surface as a portion of a wall surface thereof, wherein the intake air passage is formed by being bent in a direction in which the intake air passage is away from the opposing surface, at a section midway between an upstream end of the intake air passage and the inner air inlet, wherein the outer air inlet is formed on a more upstream side than the bent portion in the intake air passage is, and a projection is provided on the opposing surface to project from a region that is opposed to the inner air inlet towards the intake surface, and the projection has a first surface that faces an upstream side in the intake air passage to guide air flowing on a side of the opposing surface toward the device air inlet of the air-stream generating device.

2. The hand dryer according to claim 1, wherein the projection has a second surface that extends from a tip of the first surface towards a downstream side in the intake air passage and is opposed to the intake surface.

3. The hand dryer according to claim 2, wherein a distance between the second surface and the intake surface is equal to or less than ½ of a distance between the opposing surface and the intake surface.

4. The hand dryer according to claim 2, wherein the first surface and the second surface are formed to avoid a region that is opposed to the device air inlet.

5. The hand dryer according to claim 4, wherein the first surface is formed on a downstream side in the intake air passage relative to a region that is opposed to the device air inlet.

6. The hand dryer according to claim 1, further comprising a third surface and a fourth surface that form the intake air passage and are opposed to each other, wherein the third surface is provided on a downstream side in the intake air passage relative to the first surface, and the fourth surface is provided on an upstream side in the intake air passage relative to the first surface.

7. The hand dryer according to claim 1, wherein the intake surface of the inner housing faces away from the air-stream generating device and toward an inner wall of the outer housing.

* * * * *